US008528700B2

(12) United States Patent
Gobyn et al.

(10) Patent No.: US 8,528,700 B2
(45) Date of Patent: Sep. 10, 2013

(54) INDUSTRIAL TRUCK WITH A LIFTING DEVICE AND A TOWING DEVICE

(75) Inventors: Albert Gobyn, Mareuil les Meaux (FR); Frank Schepp, Griesheim (DE); Udo Supp, Worth (DE)

(73) Assignee: Still SAS, Marne la Vallee (FR)

( * ) Notice: Subject to any disclaimer, the term of this patent is extended or adjusted under 35 U.S.C. 154(b) by 540 days.

(21) Appl. No.: 12/334,679

(22) Filed: Dec. 15, 2008

(65) Prior Publication Data

US 2009/0159371 A1 Jun. 25, 2009

(30) Foreign Application Priority Data

Dec. 21, 2007 (DE) ..... 10 2007 062 019
Aug. 5, 2008 (DE) ..... 10 2008 036 411

(51) Int. Cl.
*B66F 9/075* (2006.01)
*B66F 9/16* (2006.01)
*B66F 9/18* (2006.01)

(52) U.S. Cl.
USPC ..... 187/237; 187/222; 414/607; 414/642; 414/785

(58) Field of Classification Search
USPC ..... 187/222, 237; 414/629, 631, 634, 414/641, 642, 540, 541, 607, 785
IPC ..... B66F 9/075, 9/12, 9/18; B66C 3/00
See application file for complete search history.

(56) References Cited

U.S. PATENT DOCUMENTS

| | | | | |
|---|---|---|---|---|
| 2,264,512 | A | 12/1941 | Dunham | |
| 3,272,287 | A * | 9/1966 | Easton | 187/244 |
| 3,567,054 | A * | 3/1971 | Emke | 414/639 |
| 3,814,272 | A * | 6/1974 | Spratt | 414/629 |
| 4,640,662 | A * | 2/1987 | Spellman, Jr. | 414/642 |
| 4,850,789 | A * | 7/1989 | Zimmerman | 414/703 |
| 6,068,086 | A * | 5/2000 | Bushong et al. | 187/237 |
| 6,135,694 | A * | 10/2000 | Trego et al. | 414/21 |
| 6,135,701 | A * | 10/2000 | Galloway, Sr. | 414/607 |
| 6,182,797 | B1 * | 2/2001 | Tebbe et al. | 187/227 |
| 6,764,270 | B1 | 7/2004 | Bernhardt et al. | |
| 6,884,018 | B1 * | 4/2005 | Dugan et al. | 414/462 |
| 6,932,555 | B2 * | 8/2005 | Dale et al. | 414/607 |
| 2004/0098146 | A1 * | 5/2004 | Katae et al. | 700/50 |

FOREIGN PATENT DOCUMENTS

| | | | |
|---|---|---|---|
| DE | 9011106 | | 10/1990 |
| EP | 1008284 | A2 | 6/2000 |
| EP | 1134180 | A2 * | 9/2001 |
| GB | 1200736 | | 7/1970 |
| JP | 58022769 | | 2/1983 |

* cited by examiner

*Primary Examiner* — Michael Mansen
*Assistant Examiner* — Stefan Kruer
(74) *Attorney, Agent, or Firm* — The Webb Law Firm

(57) ABSTRACT

An industrial truck (1) has a lifting device (9) including a movable load bearing implement (11) having a fork-shaped load handling attachment (14) and a towing device (20). The load handling attachment (14) has at least one load segment (14*b*) which is mounted so that it can be pivoted around an essentially horizontal pivoting axis (15). In one embodiment of the invention, the towing device (20) is located in the vicinity of the lifting device (9).

16 Claims, 2 Drawing Sheets

INDUSTRIAL TRUCK WITH A LIFTING DEVICE AND A TOWING DEVICE

CROSS REFERENCE TO RELATED APPLICATIONS

This application claims priority to German applications DE 10 2007 062 019.7, filed Dec. 21, 2007, and DE 10 2008 036 411.8, filed Aug. 5, 2008, both of which applications are herein incorporated by reference in their entirety.

BACKGROUND OF THE INVENTION

1. Field of the Invention

This invention relates to an industrial truck with a lifting device that has a load bearing implement that can be raised and lowered and is provided with at least one fork-shaped load handling attachment and also has a towing device for the transport of trailers.

2. Technical Considerations

The internal transport of goods and flow of materials, in particular the supply of materials to production lines in production plants, is generally accomplished by trailers on which the goods are transported inside the production plant, in particular by means of palettes.

To pull one or more of these trailers, industrial trucks in the form of industrial tractors are used, which are equipped with a towing device to which one or more trailers can be attached. Industrial tractors of this type have compact dimensions. As a result of which, the transport trailers can be transported safely over the narrow transport paths inside the production plant.

For the loading and unloading of the trailers, industrial trucks in the form of fork lift trucks are used which are provided with a lifting device, such as a lift mast, on which a fork carrier that has fork arms is located so that it can be raised and lowered. Fork lift trucks are generally provided with a towing device in the area opposite the lift mast. Because the fork arms project forward in the direction of travel, fork lift trucks of this type take up a great deal of space in the longitudinal direction of the vehicle. As a result of which, such fork lift trucks can be used only to a limited extent to pull trailers for the transport of goods and the flow of materials on the narrow transport paths inside a production plant.

Consequently, two industrial trucks are required for the internal transport of goods and the flow of materials inside a production plant. The transport trailers are towed inside the production plant using the industrial tractor and the transport trailers are loaded and unloaded using a fork lift truck.

Because two different industrial trucks must be used, which must generally be operated by two different operators, the internal transport of goods and the flow of materials inside a production plant is a complex, time-consuming and expensive operation.

It is an object of this invention to provide an industrial truck with which the internal transport of goods and flow of materials can be handled more easily, more quickly and less expensively compared to the use of conventional vehicles.

SUMMARY OF THE INVENTION

In one non-limiting embodiment, this object can be accomplished with a load handling attachment that has at least one load segment mounted so that it can be pivoted around an essentially horizontal pivoting axis. The invention therefore makes available an industrial truck which is provided with a towing device for the towing of trailers and on which the fork-shaped load handling attachment located on the lifting device has folding load segments. In this manner, an industrial truck is made available in a simple manner which on one hand performs the function of a industrial tractor, whereby on account of the folding load segments of the load handling attachment, compact dimensions of the industrial truck can be achieved in the longitudinal direction of the vehicle for the towing of one or more trailers, and on the other hand performs the function of a fork lift truck with which the trailers can be loaded and unloaded. As a result, only one industrial truck of the invention is needed for the internal transport of goods and the flow of materials, in particular on narrow transport routes. The industrial truck of the invention can be operated by a single operator and can both tow and load/unload the transport trailers. As a result of which, the internal transport of goods and flow of materials can be performed more easily and more economically.

The towing device can be located separately from the lifting device on opposite ends of the industrial truck. In one embodiment of the invention, the towing device is located in the vicinity of the lifting device. As a result, the industrial truck of the invention can easily be fabricated from an existing fork lift truck or from an existing industrial tractor.

The towing device can be attached rigidly to the industrial truck. It is particularly advantageous if the height of the towing device can be adjusted. The height can be adjusted manually or automatically, for example electrically or hydraulically.

In one embodiment of the invention, the load segments of the load handling attachment can be pivoted between a horizontal position and a vertical position. When the load segments of the load handling attachment are in the horizontal position, the industrial truck of the invention thereby performs the function of a fork lift truck that can be used for the loading and unloading of the transport trailers. When the load segments of the load handling attachment are folded into the vertical position, the industrial truck of the invention performs the function of a industrial tractor with compact dimensions in the longitudinal direction of the vehicle, and transport trailers can be towed safety on narrow transport routes inside a production plant by the towing device located in the vicinity of the lifting device.

It is particularly advantageous if, as in one development of the invention, the load segment of the load handling attachment can be pivoted by an auxiliary power device, such as a hydraulic cylinder. With an auxiliary power device of this type, it is possible to switch the industrial truck between the fork-lift function and the industrial-tractor function much more quickly than by manually folding or unfolding the load segments of the load handling attachment.

If, as in one development of the invention, the load segments of the load handling attachment can be pivoted by the auxiliary power device from a driver's position, the result is that the industrial truck of the invention is also safer, more reliable and easier to operate during the operation of folding the load segments of the load handling attachment out and in.

Particular advantages can be achieved if the towing device is located on the load bearing implement. The towing device can be located on the load bearing implement between the folding load segments, whereby the height of the towing device can be easily adjusted by the load bearing implement.

The industrial truck advantageously has an electrical drive system, whereby the driver's position is located between a front-end drive section which is provided with a steerable drive wheel and a rear-end chassis segment. The industrial truck can be provided with load rollers in the vicinity of the rear-side chassis segment. This construction of the industrial truck of the invention corresponds to the typical construction of an industrial tractor. As a result of which, the industrial truck of the invention can be derived from an existing industrial tractor. An industrial truck of this type has a short wheelbase and, when functioning as an industrial tractor with the load segments of the load handling attachment folded vertically, makes it possible to keep the dimensions of the industrial truck compact.

In one development of the invention, a battery compartment can be located on the rear-end chassis segment to hold an energy supply device, such as a battery block.

Particular advantages can be achieved if a battery compartment to hold an energy supply device, such as a battery block, is located in the vicinity of the drive section.

It is particularly advantageous if the lifting device that is provided with the folding load segments and the trailer device is located in the vicinity of the rear-end chassis segment. When the industrial truck is functioning as a fork lift, the drive section, with the energy supply device in the battery compartment located opposite the lifting device, acts as a counterweight. As a result of which, a safer loading and unloading of the transport cars become possible. It is also possible, however, to locate the lifting device and/or the towing device in the vicinity of the drive section. In this arrangement, the battery compartment acts as a counterweight when the industrial truck is functioning as a fork lift truck.

The lifting device advantageously has a stationary fixed mast in which the load bearing implement is located so that it can be moved up and down by a lift drive, such as by a hydraulic cylinder. A lifting device of this type requires little construction effort and easily makes it possible to achieve a lifting height that is adequate for the loading and unloading of conventional transport trailers that are towed with the industrial truck.

In one embodiment of the invention, the driver's position on the industrial truck of the invention is in the form of a standing platform for an operator who operates the truck in a standing position. Because the driver's position is in the form of a standing platform, it becomes possible to achieve compact dimensions of the industrial truck in the longitudinal direction of the vehicle. In addition, when the driver's position is in the form of a standing platform, a low entry height for the operator becomes possible. As a result of which, the industrial truck offers good ergonomic conditions.

In one embodiment, the industrial truck of the invention can have an overall width of a maximum of 900 mm, such as a maximum of 800 mm. This width corresponds to the typical width of an industrial tractor from which the industrial truck of the invention can be derived.

If, when the load segments of the load handling attachment are in the horizontal position, an embodiment of the industrial truck of the invention can have a total length of a maximum of 1800 mm, such as a maximum of 1700 mm. This results in a compact industrial truck which can be used for the internal transport of goods and flow of materials, in particular the supply of materials to production lines in production plants over narrow transport routes, and for the loading and unloading of the transport trailers in constricted loading or unloading sites.

In one embodiment, the industrial truck of the invention can have an entry height of a maximum of 150 mm, such as a maximum of 135 mm, for the driver. The ergonomics of the truck are advantageous and provide easy entry and exit for the operator.

In addition, an embodiment of the industrial truck of the invention can have a maximum lift height of 1250 mm. A lift height of this type can be achieved with little construction effort by a lift platform formed by a fixed mast and a load bearing implement located in the fixed mast. At this lift height, the loading and unloading of the trailers are facilitated.

In one embodiment of the invention, the load bearing implement is a fork carrier, on which two folding load segments of the load handling attachment are pivotably mounted with some lateral separation between them. As a result, less construction effort is required because the two folding load segments that form the fork-shaped load handling attachment are pivotably mounted directly on the load bearing implement, which is in the form of a fork carrier.

In an additional embodiment of the invention, the load bearing implement is a fork carrier and the load handling attachment is formed by two fork arms with some lateral distance between them, each of which has a fork backpiece on which a load segment is pivotably mounted and by means of which the fork arm is fastened to the fork carrier. The fork-shaped load handling attachment is therefore formed by two fork arms, each of which has a folding load segment which is pivotably mounted on the fork backpiece. The fork arms are fastened by the fork backpiece to the load bearing implement which is in the form of a fork carrier. With such folding fork arms, which can be movably fastened, for example, to the side of the fork carrier, the lateral distance between the two load segments can be varied to achieve an adaptation of the fork-shaped load handling attachment to different load bearing implements, for example pallets, roll-containers or storage containers for miscellaneous parts.

Additional advantages and details of the invention are explained in greater detail below on the basis of the exemplary embodiments illustrated in the accompanying drawing figures, wherein like reference numbers identify like parts throughout.

DESCRIPTION OF THE PREFERRED EMBODIMENTS

Figure 1:
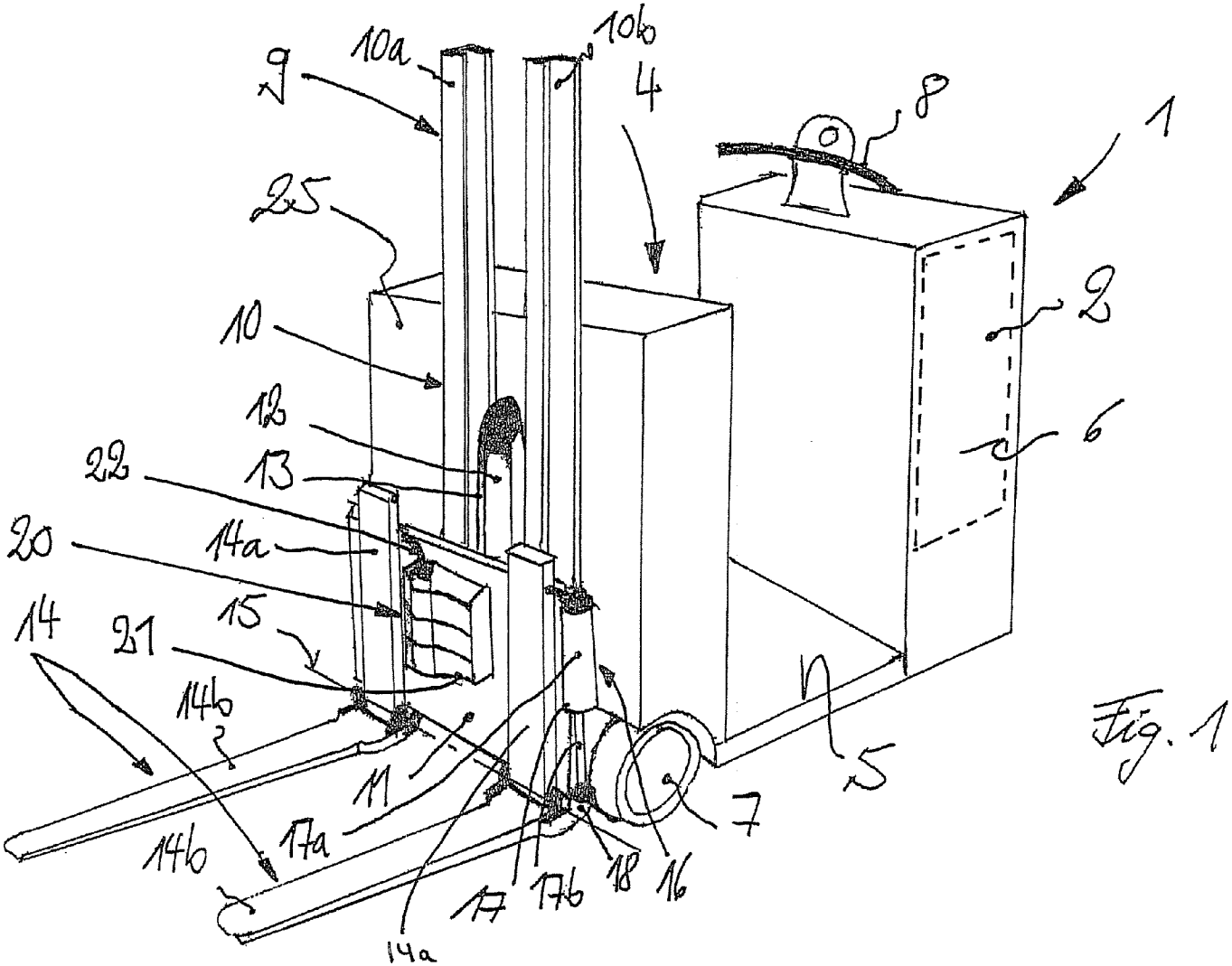
FIG. 1 shows a first exemplary embodiment of an industrial truck of the invention in a perspective view.

FIG. 1 shows an industrial truck 1 of the invention in a perspective view. The industrial truck 1, viewed in the longitudinal direction of the vehicle, has a front-end drive section 2 in which at least one drive wheel 3 (see FIG. 2) is located. The industrial truck 1 has an electrical drive system E that comprises an electrical traction drive motor and steering motor which are located in the drive section 2 and are effectively connected with the drive wheel 3. An electronic control unit and a service brake can also be located in the drive section 2. In one embodiment, located in the drive section 2 or adjacent to the drive section 2 is a battery compartment 6, in which an energy supply device for the electrical drive system can be located, such as a battery block, for example.

Adjacent to the drive section 2 and the battery compartment 6, the industrial truck 1 has a driver's position 4 which is formed by a standing platform 5. Adjacent to the driver's position 4 is a rear-end chassis segment 25 which is provided with load rollers 7.

For the operation of the industrial truck 1, a control mechanism 8 similar to a steering wheel is provided, which is located on the upper side of the drive section 2.

On the rear-end chassis segment 25 or adjacent to the rear-end chassis segment 25, the industrial truck 1 is provided with a lifting device 9. The lifting device 9 can be in the form of a lifting framework with a stationary fixed mast 10 which has two vertically oriented fixed mast profiles 10*a*, 10*b* which are separated from each other in the transverse direction of the vehicle and can be fastened, for example, to the rear-end chassis segment 25. In the fixed mast profiles 10*a*, 10*b* there is a load bearing implement 11 which is in the form of a plate-shaped fork carrier which can raised and lowered by guide rollers (not shown). To raise and lower the load bearing implement 11, there is a lifting drive 12 which can be in the form of a lifting cylinder, for example, and which is connected with the load bearing implement 11 by a lifting means 13, for example, a lifting chain.

The load bearing implement 11 is used to hold a fork-shaped load handling attachment 14 which, in the exemplary embodiment illustrated in FIG. 1, is formed by two fork arms which are separated from each other laterally. The two fork arms each have a vertical fork backpiece 14*a*, by means of which the fork arms are fastened to the load bearing implement 11 which is in the form of a fork carrier. The fork arms also each have a load segment 14*b*, which the invention teaches is mounted on the fork backpiece 14*a* so that it can pivot around a pivoting axis 15 which is horizontal or essentially horizontal. The two fork arms can thereby be displaced laterally by means of the fork backpieces 14*a* on the load bearing implement 11 which is realized in the form of a fork carrier.

To pivot the load segments 14*b*, a bearing boring for a bearing bolt that forms the pivoting axis 15 can be provided on the fork backpiece 14*a* of the corresponding fork arm, whereby the load segment 14*b* is provided with a fork-shaped widened portion which forms corresponding receptacles for the bearing bolts.

Figure 2:
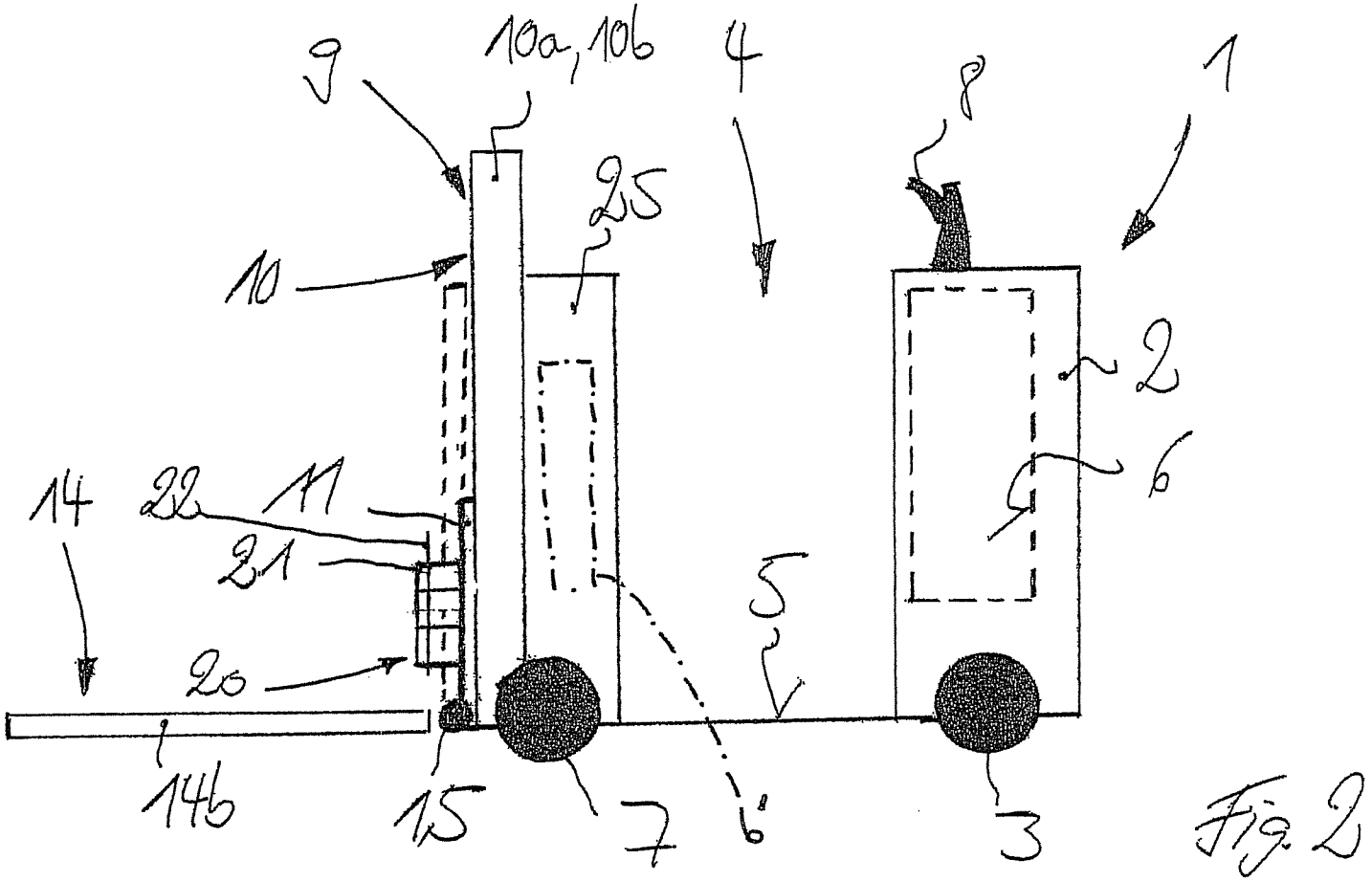
FIG. 2 shows a second exemplary embodiment of an industrial truck of the invention in a side view.

The load segment 14*b* can thereby be pivoted by an auxiliary power device 16, which can be in the form of a hydraulic cylinder 17, for example, between a horizontal position illustrated by solid lines in FIG. 2 and a vertical position illustrated by broken lines in FIG. 2.

The auxiliary power device 16 in the form of a hydraulic cylinder 17 is thereby fastened with a cylinder tube 17*a* to the corresponding fork backpiece 14*a* and is effectively connected with an extendable and retractable piston rod 17*b* with a lever arm 18 of the load segment 14*b* of the respective fork arm.

In the exemplary embodiment of the invention illustrated in FIG. 2, the fork-shaped load handling attachment 14 is formed by two load segments 14*b* which are separated laterally from each other and are pivotably fastened directly to the load bearing implement 11 which is in the form of a fork carrier. To pivot the load segments 14*b*, a bearing boring can be provided in the load bearing implement 11 for a bearing bolt that forms the pivoting axis 15. The load segment 14*b* is provided with a fork-shaped widened portion which forms corresponding receptacles for the bearing bolts. If the auxiliary power device 16 is a hydraulic cylinder, the load segments 14*b* can be pivoted if the piston rod of the hydraulic cylinder is effectively connected with the corresponding load segment 14*b* by a corresponding lever arm, and a cylinder tube of the hydraulic cylinder is fastened to the load bearing implement 11 which is in the form of a fork carrier. It is also possible to provide only an auxiliary power device 16, such as a hydraulic cylinder, for example, which is fastened to the load bearing implement 11 and is effectively connected with both load segments 14*b*.

The invention teaches that in the exemplary embodiment illustrated in FIG. 1 and the exemplary embodiment illustrated in FIG. 2, a towing device 20 is also provided in the vicinity of the lifting device 9 for the transport of trailers. In the illustrated exemplary embodiment, the towing device 20 has a plurality of flange plates 21 which are separated vertically from one another, in which a coupling pin 22 can be located. The towing device 20 is thereby located and fastened to the load bearing implement 11, for example, between the fork backpieces 14*a* of the two fork arms (FIG. 1) or the folding load segments 14*b* of the load handling attachment 14 (FIG. 2). The towing device 20 can be actuated manually or can be an automatic coupling device actuated from the driver's position by a corresponding actuation mechanism.

By means of the auxiliary power device 16, the load segments 14*b* of the load handling attachment 14 that are mounted so that they can pivot around the pivoting axis 15 both in the exemplary embodiment illustrated in FIG. 1 and in the exemplary embodiment illustrated in FIG. 2 can be pivoted from the horizontal position illustrated by solid lines in FIG. 2 into a vertical position illustrated in broken lines.

In the vertical position of the load segments 14*b* of the load handling attachment 14, one or more trailers can be towed on the towing device 20 of the industrial truck 1. As a result of which, the industrial truck 1 can perform the function of a industrial tractor which has compact dimensions in the longitudinal direction of the vehicle and can be used to pull trailers, and can thus be used for the transport of goods and the flow of materials inside a production plant on narrow transport routes, and is therefore suitable for the supply of materials to production lines in production plants.

In the horizontal position of the load segments 14*b* of the load handling attachment 14, the industrial truck 1 performs the function of a fork lift truck in which the drive section 2 and the battery block located in the battery compartment 6 act as a counterweight. The trailers can thereby be loaded and unloaded by the lifting device 9 and the fork-shaped load handling attachment 14 which is located on the load bearing implement 11 which is realized in the form of a fork carrier so that it can move up and down. On account of the realization with a fixed mast 10 and a load bearing implement 11 that is located so that it can move up and down in the fixed mast 10, the lifting device 9 thereby has a sufficient lifting height to load and unload the trailers.

For the actuation of the auxiliary power device 16 and of the lifting drive 12, corresponding actuation devices are provided, for example switches located on the control mechanism 8. As a result of which, the load bearing implement 11 provided with the folding load segments 14*b* can be raised and lowered from the driver's position 4 and the load segments 14*b* of the load handling attachment 14 can be pivoted in and out from the driver's position 4. The industrial truck 1 can thus be operated from the driver's position 4, as a result of which the industrial truck 1 is easy and safe to operate and offers good ergonomic conditions.

In one realization of the lifting drive 12 in the form of a lifting cylinder and of the auxiliary power device 16 in the form of a hydraulic cylinder 17, they can be powered by an electrically driven hydraulic unit that can be located in the vicinity of the rear-end chassis segment 25 or in the drive section 2.

In contrast to the illustrated exemplary embodiments of an industrial truck 1 in which the lifting device 9 and the towing device 20 are located on the rear end in the vicinity of the rear-end chassis segment 25, the lifting device 9 and/or the towing device 20 can also be located on the front end in the vicinity of the drive section 2.

It is also possible to locate the towing device 20 on the rear end on the rear chassis segment 25 and the lifting device 9 on the front end on the drive section, or the lifting device 9 on the rear end on the rear-end chassis segment 25 and the towing device 20 on the front end on the drive section 2.

Instead of locating the battery compartment 6 in the drive section 2 (as shown in FIG. 1), the battery compartment could alternately be located on the rear-end chassis segment 25 (as shown by dash-dot lines 6' in FIG. 2).

The industrial truck 1 can thereby be developed from a industrial tractor which is provided, as illustrated in FIGS. 1 and 2, with a drive section 2 and a rear-end chassis segment 25 as well as with a driver's position 4 located in between.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

The invention claimed is:

1. An industrial truck, comprising:

a lifting device comprising a movable load bearing implement including a fork-shaped load-handling attachment and a towing device for the transport of trailers;

wherein the movable load bearing implement comprises a fork carrier and the load handling attachment includes a air of fork arms separated laterally from each other, the towing device directly mounted to the fork carrier such that a height of the towing device is adjustable, the towing device comprising a plurality of vertically spaced-apart flange plates and a coupling pin inserted between said plates such that a height of said pin is adjustable, each of the fork arms having a load segment pivotably secured to the movable load bearing implement around a substantially horizontal pivoting axis, and wherein the towing device is positioned laterally between the pair of fork arms.

2. The industrial truck as recited in claim 1, wherein the load segment of the load handling attachment is pivotable by means of an auxiliary power device.

3. The industrial truck as recited in claim 2, wherein the load segment of the load handling attachment is pivotable by means of the auxiliary power device from a driver's position.

4. The industrial truck as recited in claim 3, wherein the auxiliary power device comprises a hydraulic cylinder.

5. The industrial truck as recited in claim 1, including an electrical drive system, wherein a driver's position is located between a front-end drive section provided with a steerable drive wheel and a rear-end chassis segment, and wherein the industrial truck includes load rollers in a vicinity of the rear-end chassis segment.

6. The industrial truck as recited in claim 5, wherein in the vicinity of the rear-end chassis segment there is a battery compartment to hold an energy supply device.

7. The industrial truck as recited in claim 5, wherein in the vicinity of the drive section there is a battery compartment to hold an energy supply device.

8. The industrial truck as recited in claim 5, wherein the lifting device is located in the vicinity of the rear-end chassis segment.

9. The industrial truck as recited in claim 5, wherein the driver's position includes a standing platform.

10. The industrial truck as recited in claim 1, wherein the lifting device includes a stationary fixed mast, in which the load bearing implement is located so that it is movable up and down by a lifting drive.

11. The industrial truck as recited in claim 1, wherein the industrial truck has an overall width of a maximum of 900 mm.

12. The industrial truck as recited in claim 1, wherein the industrial truck, when the load segments of the load handling attachment are in the horizontal position, has an overall length of a maximum of 1800 mm.

13. The industrial truck as recited in claim 1, wherein the industrial truck has an entry height of a maximum of 150 mm.

14. The industrial truck as recited in claim 1, wherein the industrial truck has a maximum lifting height of 1250 mm.

15. The industrial truck as recited in claim 1, wherein the load segment of each fork arm is pivotably secured to the movable load bearing implement via a fork backpiece, with each load segment pivotable relative to the respective fork backpiece.

16. The industrial truck as recited in claim 1, wherein the load segment of each fork arm is pivotably secured to the movable load bearing implement via the load bearing implement, with each load segment pivotable relative to the load bearing implement.

* * * * *

UNITED STATES PATENT AND TRADEMARK OFFICE

CERTIFICATE OF CORRECTION

PATENT NO. : 8,528,700 B2
APPLICATION NO. : 12/334679
DATED : September 10, 2013
INVENTOR(S) : Albert Gobyn et al.

It is certified that error appears in the above-identified patent and that said Letters Patent is hereby corrected as shown below:

In the Claims

Column 7, Line 25, Claim 1, delete "air" and insert -- pair --

Signed and Sealed this
Fourth Day of February, 2014

Michelle K. Lee

Michelle K. Lee
*Deputy Director of the United States Patent and Trademark Office*